US009253836B2

(12) United States Patent
Liao et al.

(10) Patent No.: US 9,253,836 B2
(45) Date of Patent: Feb. 2, 2016

(54) LIGHT-EMITTING DEVICE

(71) Applicant: LEXTAR ELECTRONICS CORPORATION, Hsinchu (TW)

(72) Inventors: Cheng-Chun Liao, Hsinchu (TW); Chia-Yen Lee, Tainan (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 185 days.

(21) Appl. No.: 14/010,039

(22) Filed: Aug. 26, 2013

(65) Prior Publication Data

US 2014/0070716 A1 Mar. 13, 2014

(30) Foreign Application Priority Data

Sep. 7, 2012 (TW) ..... 101132758 A

(51) Int. Cl.
*H05B 33/08* (2006.01)

(52) U.S. Cl.
CPC ..... *H05B 33/0824* (2013.01); *H05B 33/083* (2013.01)

(58) Field of Classification Search
CPC ..... H05B 33/0824; H05B 33/083; H05B 33/0827; H05B 33/0806; H05B 33/0821
See application file for complete search history.

(56) References Cited

U.S. PATENT DOCUMENTS

| | | | | |
|---|---|---|---|---|
| 8,692,475 | B2 * | 4/2014 | Wang | 315/232 |
| 2010/0006867 | A1 | 1/2010 | Lee et al. | |
| 2014/0210367 | A1 * | 7/2014 | Zijlman | 315/188 |
| 2014/0265894 | A1 * | 9/2014 | Weaver | 315/193 |
| 2015/0108909 | A1 * | 4/2015 | Rupp | 315/188 |

FOREIGN PATENT DOCUMENTS

| | | | |
|---|---|---|---|
| TW | 200830665 | A | 7/2008 |
| TW | 201212710 | A | 3/2012 |

* cited by examiner

*Primary Examiner* — Jung Kim
(74) *Attorney, Agent, or Firm* — Moser Taboada

(57) ABSTRACT

A light-emitting device includes a power module, a first light-emitting module, a second light-emitting module, a third light-emitting module, and a control module. The power module is configured to rectify an AC voltage for providing a periodic driving voltage. The first, second, third light-emitting modules are connected in series. The control module is configured to make the first, second, third light-emitting modules being driven by the driving voltage in response to different driving stages in a cycle period of a driving voltage. An average-diode-junction-area of the first light-emitting module is different from an average-diode-junction-area of the second light-emitting module or an average-diode-junction-area of the third light-emitting module.

10 Claims, 12 Drawing Sheets

LIGHT-EMITTING DEVICE

RELATED APPLICATIONS

This application claims priority to Taiwan Application Serial Number 101132758, filed Sep. 7, 2012, which is herein incorporated by reference.

BACKGROUND

1. Field of Invention

The present invention is directed to an electronic device. More particularly, the present invention is directed to a light-emitting device.

2. Description of Related Art

With advances in semi-conductor technology, light-emitting diodes have been widely used in our daily life because of having advantages like long lifetime, high switching speed, and small size.

FIG. 1 is a diagram illustrating an operating waveform of a light-emitting diode in prior art. As shown in FIG. 1, an input voltage $V_{in}$ is a rectified AC voltage. When the input voltage $V_{in}$ is greater than a threshold voltage $V_{hv}$ of the light-emitting diode, the light-emitting diode is turned on and emits light, and, when the input voltage $V_{in}$ is smaller than the threshold voltage $V_{hv}$ of the light-emitting diode, the light-emitting diode is turned off. The ON period is $T_{on}$ and the OFF period is $T_{off}$. Every two ON periods Ton are spaced by one OFF period $T_{off}$, such that the light-emitting diode may flicker when the input voltage $V_{in}$ varies and make people feel uncomfortable.

On the other hand, due to the limited light-emitting properties of the light-emitting diodes, a portion of the input voltage $V_{in}$ is consumed on components other than LED (i.e., the region Z with slant lines) and thus this causes a low luminous efficiency of LED.

SUMMARY

For solving the problems above mentioned, one aspect of the present invention provides a light-emitting device having multiple driving stages, in which light-emitting diodes inside can have a higher luminous efficiency.

In accordance with one embodiment of the present invention, the light-emitting device includes a power module, a first light-emitting module, a second light-emitting module, a third light-emitting module, and a control module. The power module is configured for rectifying an AC voltage to provide a driving voltage, in which the driving voltage is periodic. The first light-emitting module, the second light-emitting module, and the third light-emitting module are electrically connected to each other in series. The control module is configured for making the first light-emitting module, the second light-emitting module, and the third light-emitting module be driven by the driving voltage in response to different driving stages in a cycle period of the driving voltage. An average-diode-junction-area of the first light-emitting module is different from an average-diode-junction-area of the second light-emitting module or an average-diode-junction-area of the third light-emitting module.

In accordance with one embodiment of the present invention, the first light-emitting module includes a light-emitting unit assembly or a plurality of light-emitting unit assemblies. When the first light-emitting module includes the plurality of light-emitting unit assemblies, the light-emitting unit assemblies in the first light-emitting module are connected in parallel with each other. The second light-emitting module includes a light-emitting unit assembly or a plurality of light-emitting unit assemblies. When the second light-emitting module includes the plurality of light-emitting unit assemblies, the light-emitting unit assemblies in the second light-emitting module are connected in parallel with each other. Each of the light-emitting unit assembly or assemblies in the first light-emitting module and the light-emitting unit assembly or assemblies in the second light-emitting module includes at least one light-emitting diode with a same diode-junction-area, and the number of the light-emitting unit assembly or assemblies in the first light-emitting module and the number of the light-emitting unit assembly or assemblies in the second light-emitting module are different, such that the average-diode-junction-area of the first light-emitting module and the average-diode-junction-area of the second light-emitting module are different.

In accordance with one embodiment of the present invention, the first light-emitting module includes a first light-emitting unit. The first light-emitting unit includes a plurality of light-emitting diodes connected to each other in series. The second light-emitting module includes a second light-emitting unit, the second light-emitting unit includes a plurality of light-emitting diodes connected to each other in series. A diode-junction-area of the light-emitting diodes of the first light-emitting unit is different from that of the light-emitting diodes of the second light-emitting unit.

In accordance with one embodiment of the present invention, an average-number-of-diode-junction of the first light-emitting module, an average-number-of-diode-junction of the second light-emitting module, and an average-number-of-diode-junction of the third light-emitting module are in a ratio of $\alpha:\beta:1$, where $\alpha$ and $\beta$ are:

$1 \leq \alpha$, and $0.5 \leq \beta$.

In accordance with one embodiment of the present invention, the average-diode-junction-area of the first light-emitting module, the average-diode-junction-area of the second light-emitting module, and the average-diode-junction-area of the third light-emitting module are in a ratio of Q:R:1, where Q and R are:

$1.1 \leq Q \leq 6$, and $0.5 \leq R \leq 4$.

In accordance with one embodiment of the present invention, the light-emitting device further includes a fourth light-emitting module. The first light-emitting module, the second light-emitting module, the third light-emitting module, and the fourth light-emitting module are electrically connected to each other in series. An average-number-of-diode-junction of the first light-emitting module, an average-number-of-diode-junction of the second light-emitting module, an average-number-of-diode-junction of the third light-emitting module, and an average-number-of-diode-junction of the fourth light-emitting module are in a ratio of $\alpha:\beta:\gamma:1$, where $\alpha$, $\beta$, and $\gamma$ are:

$2 \leq \alpha$, $0.5 \leq \beta$, and $0.5 \leq \gamma$.

In accordance with one embodiment of the present invention, the light-emitting device further includes a fourth light-emitting module. The first light-emitting module, the second light-emitting module, the third light-emitting module, and the fourth light-emitting module are electrically connected to each other in series. The average-diode-junction-area of the first light-emitting module, the average-diode-junction-area of the second light-emitting module, the average-diode-junction-area of the third light-emitting module, and an average-diode-junction-area of the fourth light-emitting module are in a ratio of Q:R:T:1, where Q, R, and T are:

$1.1 \leq Q \leq 6$, $0.5 \leq R \leq 4$, and $0.5 \leq T \leq 4$.

In accordance with one embodiment of the present invention, the light-emitting device further includes a fourth light-emitting module and a fifth light-emitting module. The first light-emitting module, the second light-emitting module, the third light-emitting module, the fourth light-emitting module, and the fifth light-emitting module are electrically connected to each other in series, an average-number-of-diode-junction of the first light-emitting module, an average-number-of-diode-junction of the second light-emitting module, an average-number-of-diode-junction of the third light-emitting module, an average-number-of-diode-junction of the fourth light-emitting module, and an average-number-of-diode-junction of the fifth light-emitting module are in a ratio of $\alpha:\beta:\gamma:\delta:1$, where $\alpha$, $\beta$, $\gamma$, and $\delta$ are:

$2\leq\alpha$, $0.5\leq\beta$, $0.5\leq\gamma$, and $0.5\leq\delta$.

In accordance with one embodiment of the present invention, the light-emitting device further includes a fourth light-emitting module and a fifth light-emitting module. The average-diode-junction-area of the first light-emitting module, the average-diode-junction-area of the second light-emitting module, the average-diode-junction-area of the third light-emitting module, an average-diode-junction-area of the fourth light-emitting module, and an average-diode-junction-area of the fifth light-emitting module are in a ratio of Q:R:T:U:1, where Q, R, T, and U are:

$1.1\leq Q\leq 6$, $0.5\leq R\leq 4$, $0.5\leq T\leq 4$, and $0.5\leq U\leq 3$.

In accordance with one embodiment of the present invention, the light-emitting device further includes a fourth light-emitting module, a fifth light-emitting module, and a sixth light-emitting module. The first light-emitting module, the second light-emitting module, the third light-emitting module, the fourth light-emitting module, the fifth light-emitting module, and the sixth light-emitting module are electrically connected to each other in series. The average-number-of-diode-junction of the first light-emitting module, the average-number-of-diode-junction of the second light-emitting module, the average-number-of-diode-junction of the third light-emitting module, an average-number-of-diode-junction of the fourth light-emitting module, an average-number-of-diode-junction of the fifth light-emitting module, and an average-number-of-diode-junction of the sixth light-emitting module are in a ratio of $\alpha:\beta:\gamma:\delta:\epsilon:1$, where $\alpha$, $\beta$, $\gamma$, $\delta$, and $\epsilon$ are:

$2\leq\alpha$, $0.5\leq\beta$, $0.5\leq\gamma$, $0.5\leq\beta$, and $0.5\leq\epsilon$.

In accordance with one embodiment of the present invention, the light-emitting device further includes a fourth light-emitting module, a fifth light-emitting module, and a sixth light-emitting module. The first light-emitting module, the second light-emitting module, the third light-emitting module, the fourth light-emitting module, the fifth light-emitting module, and the sixth light-emitting module are electrically connected to each other in series. The average-diode-junction-area of the first light-emitting module, the average-diode-junction-area of the second light-emitting module, the average-diode-junction-area of the third light-emitting module, an average-diode-junction-area of the fourth light-emitting module, an average-diode-junction-area of the fifth light-emitting module, and an average-diode-junction-area of the sixth light-emitting module are in a ratio of Q:R:T:U:V:1, where Q, R, T, U, and V are:

$1.1\leq Q\leq 6$, $0.5\leq R\leq 4$, $0.5\leq 4$, $0.5\leq U\leq 4$, and $0.5\leq V\leq 3$.

Another aspect of the invention provides a light-emitting device having multiple driving stages. The light-emitting device can be utilized to solve flickering problem of light-emitting diodes.

In accordance with one embodiment of the present invention, the light-emitting device includes a power module, a first light-emitting module, a second light-emitting module, and a control module. The power module is configured for rectifying an AC voltage for providing a driving voltage, in which the driving voltage is periodic. The first light-emitting module and the second light-emitting module are electrically connected to each other in series. The control module is configured for making the first light-emitting module, and the second light-emitting module be driven by the driving voltage in response to different driving stages in a cycle period of the driving voltage. In a first driving stage, the control module makes the first light-emitting module being driven by the driving voltage, and provides a first driving current to the first light-emitting module, and a first cross voltage is present across the first light-emitting module. In a second driving stage, the control module makes the first light-emitting module and the second light-emitting module being driven by the driving voltage, and provides a second driving current to the first light-emitting module and the second light-emitting module, and a second cross voltage is present across the first light-emitting module and the second light-emitting module. A difference between a product of the first cross voltage and the first driving current and a product of the second cross voltage and the second driving current is smaller than a predetermined threshold, such that a difference of luminous fluxes of the first light-emitting module and the second light-emitting module between the first driving stage and the second driving stage is smaller than a predetermined ratio.

In accordance with one embodiment of the present invention, the light-emitting device further includes a third light-emitting module being electrically connected to the first light-emitting module and the second light-emitting module in series. In a third driving stage, the control module makes the first light-emitting module, the second light-emitting module, and the third light-emitting module being driven by the driving voltage, and provides a third driving current to the first light-emitting module, the second light-emitting module, and the third light-emitting module, and a third cross voltage is present across the first light-emitting module, the second light-emitting module, and the third light-emitting module. In a fourth driving stage, the control module makes the first light-emitting module and the second light-emitting module being driven by the driving voltage, and provides a fourth driving current to the first light-emitting module and the second light-emitting module, and a fourth cross voltage is present across the first light-emitting module and the second light-emitting module. In a fifth driving stage, the control module makes the first light-emitting module being driven by the driving voltage, and provides a fifth driving current to the first light-emitting module, and a fifth cross voltage is present across the first light-emitting module. Differences between the product of the first cross voltage and the first driving current, the product of the second cross voltage and the second driving current, a product of the third cross voltage and the third driving current, a product of the fourth cross voltage and the fourth driving current, and a product of the fifth cross voltage and the fifth driving current, are smaller than another predetermined threshold, such that differences of luminous fluxes of the first light-emitting module, the second light-emitting module, and the third light-emitting module between the first driving stage, the second driving stage, the third driving stage, the fourth driving stage, and the fifth driving stage are smaller than another predetermined ratio.

In accordance with one embodiment of the present invention, a difference between a maximum and a minimum among the product of the first cross voltage and the first driving current, the product of the second cross voltage and the second driving current, the product of the third cross voltage and the third driving current, the product of the fourth cross voltage and the fourth driving current, and the product of the fifth cross voltage and the fifth driving current is a first value. A sum of the maximum and the minimum among the product of the first cross voltage and the first driving current, the product of the second cross voltage and the second driving current, the product of the third cross voltage and the third driving current, the product of the fourth cross voltage and the fourth driving current, and the product of the fifth cross voltage and the fifth driving current is a second value. A quotient of the first value divided by the second value is smaller than 24%.

In accordance with one embodiment of the present invention, the first driving current is greater than or equal to the fifth driving current.

In accordance with one embodiment of the present invention, the second driving current is greater than or equal to the fourth driving current.

In accordance with one embodiment of the present invention, the light-emitting device further includes a power storage module being electrically connected to the first light-emitting module. The power storage module is charged or discharged corresponding to the driving voltage, and is configured to selectively drive the first light-emitting module.

In accordance with one embodiment of the present invention, the light-emitting device further includes a plurality of power storage modules. The first light-emitting module includes a plurality of light-emitting units, in which the light-emitting units are electrically connected to each other. The power storage modules are selectively and electrically connected to the light-emitting units in series or in parallel, and are charged or discharged corresponding to the driving voltage, and are configured to selectively drive the light-emitting units.

In accordance with one embodiment of the present invention, the power storage module includes a capacitor or an inductor.

In accordance with one embodiment of the present invention, the light-emitting device further includes a power storage module and an anti-backflow module. The power storage module is electrically connected to the second light-emitting module in parallel, is configured for being charged or discharged corresponding to the driving voltage, and is configured for selectively driving the second light-emitting module. The anti-backflow module is electrically connected between the first light-emitting module and the second light-emitting module in series.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
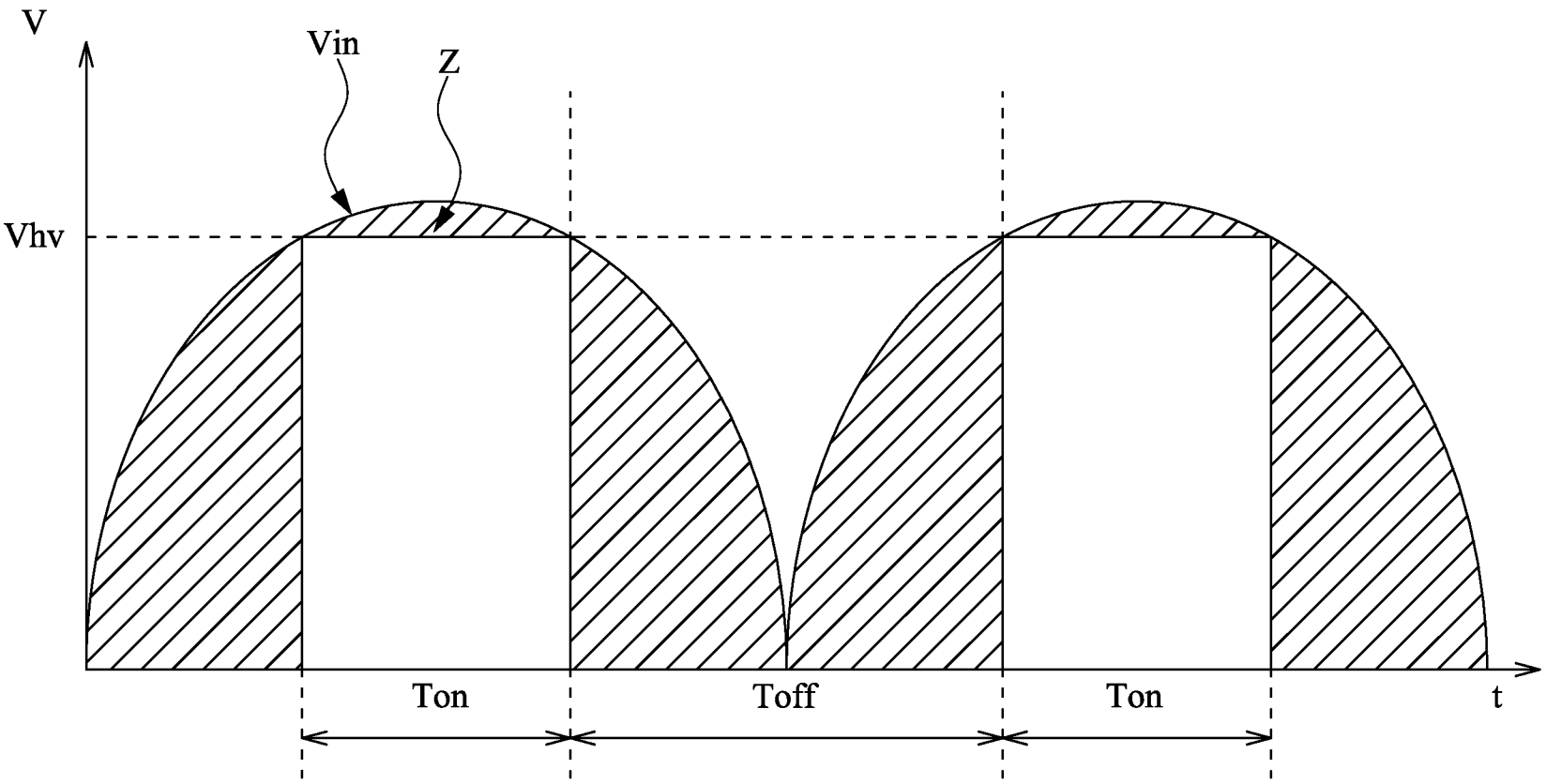
( PRIOR ART ) Fig. 1
FIG. 1 is a diagram illustrating an operating waveform of a light-emitting diode in prior art.

In the following detailed description, for purposes of explanation, numerous specific details are set forth in order to attain a thorough understanding of the disclosed embodiments. It will be apparent, however, that one or more embodiments may be practiced without these specific details. In other instances, well-known structures and devices are schematically shown in order to simplify the drawing.

One aspect of the invention is a light-emitting device has 2N−(minus) 1 driving stages, and the light-emitting device includes N light-emitting modules, in which N is an integer. In a $P^{th}$ driving stage, if P is smaller than or equal to N, light-emitting modules from a $1^{st}$ light-emitting module to a $N^{th}$ light-emitting module are driven and emit light, while if P is greater than N, light-emitting modules from the $1^{st}$ light-emitting module to a $(2N-(\text{minus})P)^{th}$ light-emitting module are driven and emit light, in which P is also an integer.

For purpose of simplification and easy understanding, light-emitting devices is described as having fifth, seventh, ninth, and eleventh driving stages as examples in the following paragraphs. However, one application of the present invention can be a light-emitting device having multiple stages, and the present invention is not limited to the examples described in the following embodiments.

Figure 2:
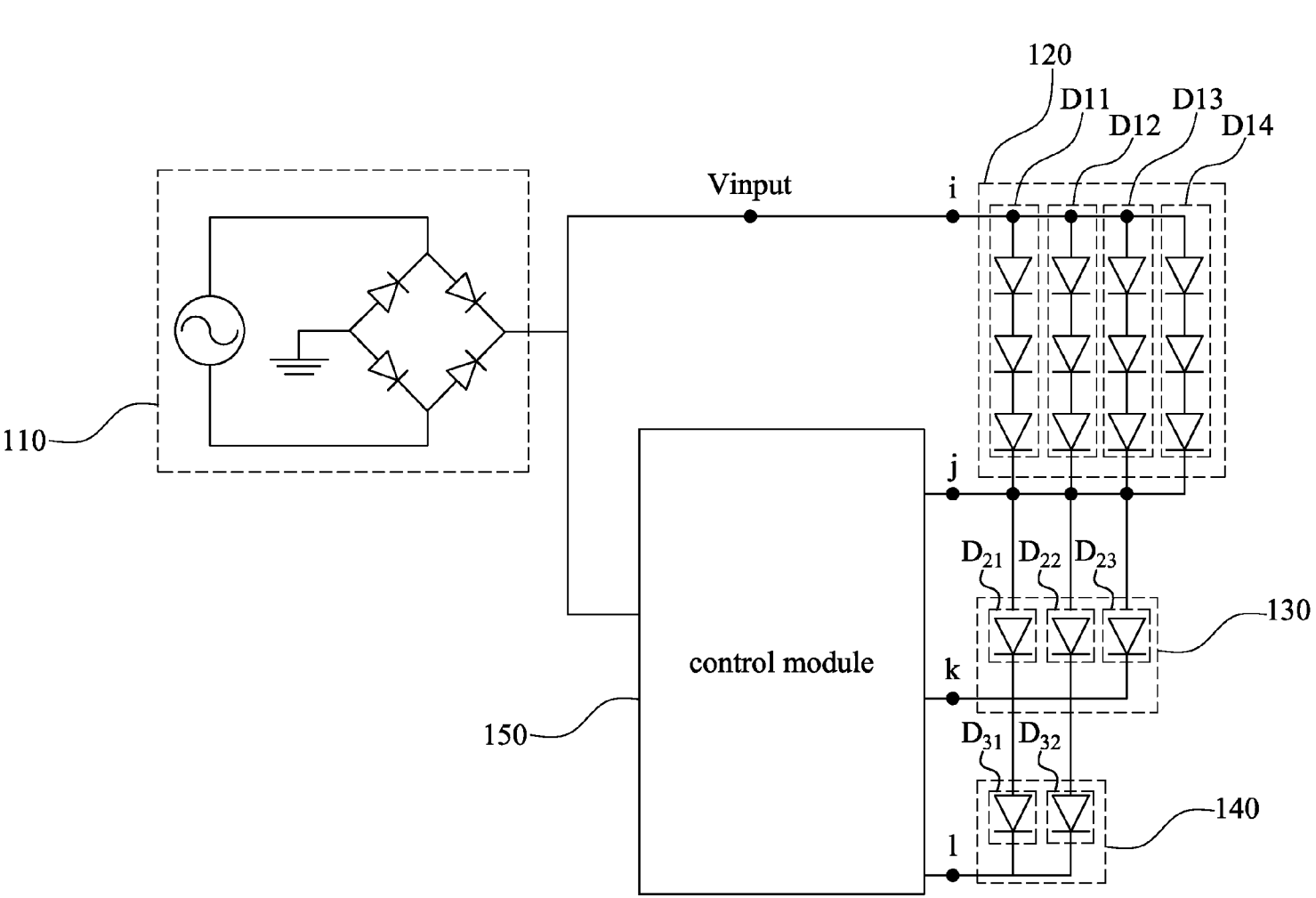
FIG. 2 is a light-emitting device in accordance with one embodiment of the present disclosure.

FIG. 2 is a light-emitting device 200 in accordance with one embodiment of the present disclosure. The light-emitting device 200 includes a power module 110, a first light-emitting module 120, a second light-emitting module 130, a third light-emitting module 140, and a control module 150. The power module 110 is configured for rectifying an AC voltage for providing a driving voltage $V_{input}$, in which the driving voltage is periodic. The power module 110 is further configured for providing basic electrical protections, such as surge protection and fuse wires. The first light-emitting module 120, the second light-emitting module 130, and the third light-emitting module 140 are electrically connected to each other in series. The control module 150 is connected to the first light-emitting module 120, the second light-emitting module 130, and the third light-emitting module 140, for making the first light-emitting module 120, the second light-emitting module 130, and the third light-emitting module 140 be driven by the driving voltage $V_{input}$ in response to different driving stages in a cycle period of the driving voltage $V_{input}$. The power module 110 and the control module 150 can be implemented by electrical circuits. The power module 110 includes an AC power supply and a rectifier. Each of the first light-emitting module 120, the second light-emitting module 130, and the third light-emitting module 140 include light-emitting diodes or light-emitting diode assemblies. There can be a plurality of different current paths passing through the light-emitting modules 120, 130, 140. Number of diode-junctions (e.g., P-N junctions) passed by the current paths can be different. Average number of the diode-junction passed by the current paths are defined as average-number-of-diode-junctions S1 of the light-emitting modules 120, average-number-of-diode-junctions S2 of the light-emitting modules 130, and average-number-of-diode-junctions S3 of the light-emitting modules 140. Values of total diode-junction-areas (e.g., P-N junction-areas) of the light-emitting modules 120, 130, 140 divided by the average-number-of-diode-junctions S1, S2, S3 of the light-emitting modules 120, 130, 140 are defined as average-diode-junction-areas A1, A2, A3 of the light-emitting modules 120, 130, 140. In one embodiment of the present invention, the luminous efficiency of the light-emitting device 200 can be improved by making the average-diode-junction-area A1 of the first light-emitting module 120 be different from the average-diode-junction-area A2 of the second light-emitting module 130 or the average-diode-junction-area A3 of the third light-emitting module 140. Details of such an embodiment would be described in later paragraphs.

In one embodiment, the control module 150 includes 3 switches electrically connected to nodes j, k, l. In a first driving stage, the control module 150 turn on the switch connected to the node j, such that the first light-emitting module 120 can be driven by the driving voltage $V_{input}$, and the control module 150 provides a driving current (e.g., using a current mirror) passing through the first light-emitting module 120 and the node j. In a second driving stage, the control module 150 turns on the switch connected to the node k, such that the first light-emitting module 120 and the second light-emitting module 130 can be driven by the driving voltage $V_{input}$, and the control module 150 provides another driving current passing through the first light-emitting module 120, the second light-emitting module 130, and the node j. In a third driving stage, the control module 150 turns on the switch connected to the node l, such that the first light-emitting module 120, the second light-emitting module 130, and the third light-emitting module 140 can be driven by the driving voltage $V_{input}$, and the control module 150 provides still another driving current passing through the first light-emitting module 120, the second light-emitting module 130, the third light-emitting module 140, and the node k. It is noted that, the configuration abovementioned are just an example, and the present invention is not limited to the light-emitting device 200 described above.

Figure 3:
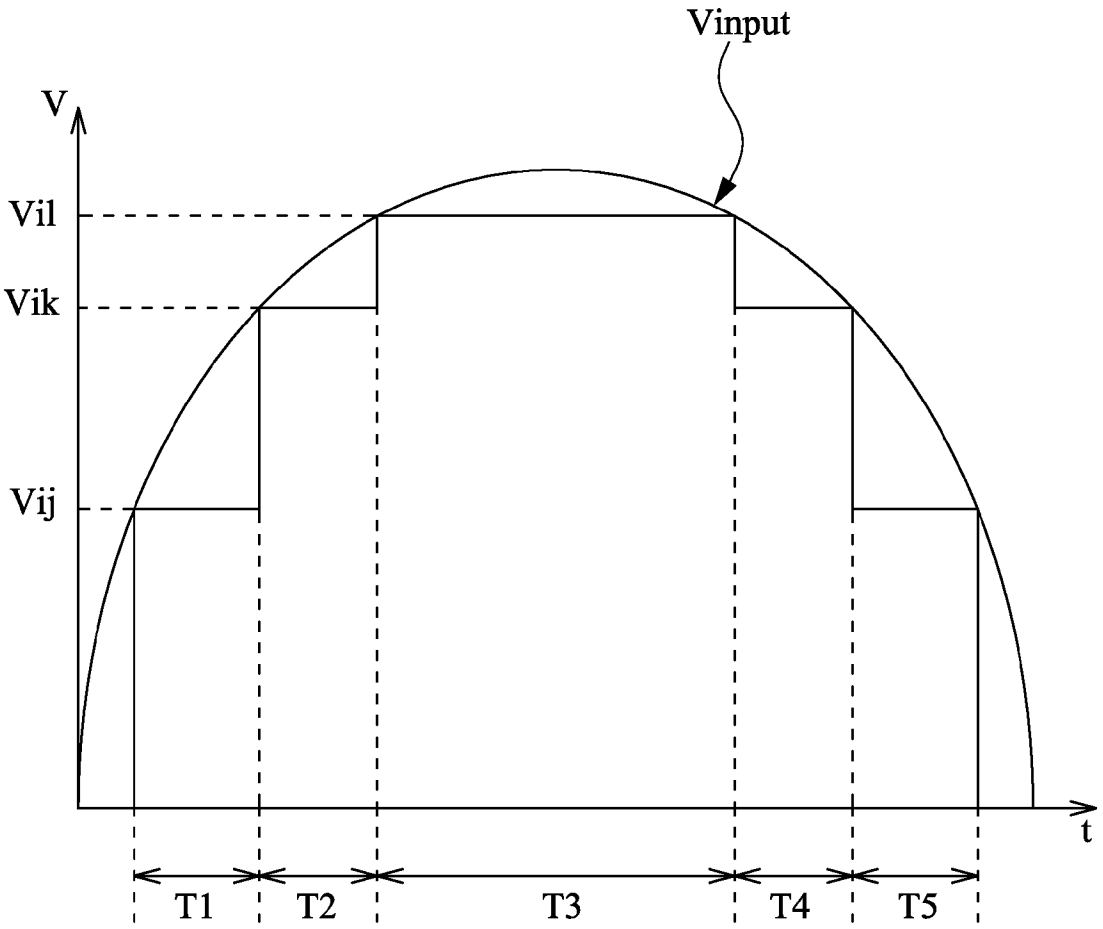
FIG. 3 is a diagram illustrating an operating waveform of the light-emitting device in FIG. 2.

Also referring to FIG. 3, in this embodiment, the light-emitting device 200 includes three light-emitting modules 120, 130, 140, and the light-emitting device 200 has 5 driving stages. In the first driving stage (i.e., period T1), the control module 150 makes the first light-emitting module 120 be driven by the driving voltage $V_{input}$, and a cross voltage $V_{ij}$ is present across two ends (i.e., the nodes i, j) of the first light-emitting module 120. In the second driving stage (i.e., period T2), the control module 150 makes the first light-emitting module 120 and the second light-emitting module 130 be driven by the driving voltage $V_{input}$, and a cross voltage $V_{ik}$ is present across two ends (i.e., the nodes i, k) of the first light-emitting module 120 and the second light-emitting module 130. In the third driving stage (i.e., period T3), the control module 150 makes the first light-emitting module 120, the second light-emitting module 130, and the third light-emitting module 140 be driven by the driving voltage $V_{input}$, and a cross voltage $V_{il}$ is present across two ends (i.e., the nodes i, l) of the first light-emitting module 120, the second light-emitting module 130, and the third light-emitting module 140. In a fourth driving stage (i.e., period T4), the control module 150 makes the first light-emitting module 120 and the second light-emitting module 130 be driven by the driving voltage $V_{input}$, and a cross voltage $V_{ik}$ is present across two ends (i.e., the nodes i, k) of the first light-emitting module 120 and the second light-emitting module 130. In a fifth driving stage (i.e., period T5), the control module 150 makes the first light-emitting module 120 be driven by the driving voltage $V_{input}$, and a cross voltage $V_{ij}$ is present across two ends (i.e., the nodes i, j) of the first light-emitting module 120.

By such a way that separately driving the first light-emitting module 120, the second light-emitting module 130, and the third light-emitting module 140 in different driving stages, the luminous efficiency of the light-emitting device 200 can be improved.

Moreover, as shown in FIG. 3, the first light-emitting module 120 is driven from period T1 to period T5, longer than the period (i.e., from period T2 to period T4) the second light-emitting module 130 being driven and the period (i.e., periods T3) the third light-emitting module 140 being driven. Therefore, in design, if light-emitting area (P-N junction-area) of the first light-emitting module 120 is greater than light-emitting area of the second light-emitting module 130 and the light-emitting area of the third light-emitting module 140, for example, the first light-emitting module 120 has more light-emitting diodes then the second light-emitting module 130 and the third light-emitting module 140 have, the average time of the light-emitting diodes in the light-emitting device 200 being driven would be longer.

In one embodiment of the present invention, the first light-emitting module 120 includes a plurality of light-emitting unit assemblies D11, D12, D13, and D14 electrically connected in parallel, in which each of the light-emitting unit assemblies D11-D14 includes a plurality of light-emitting units electrically connected in series. The second light-emitting module 130 includes a plurality of light-emitting unit assemblies D21, D22, and D23, electrically connected in parallel, in which each of the light-emitting unit assemblies D21-D23 include one light-emitting unit. The third light-emitting module 140 includes a plurality of light-emitting unit assemblies D31 and D32, electrically connected in parallel, in which each of the light-emitting unit assemblies D31 and D32 includes one light-emitting unit.

For example, in the above configuration, the first light-emitting module 120 includes 12 light-emitting units, the second light-emitting module 130 includes 3 light-emitting units, and the third light-emitting module 140 includes 2 light-emitting units. In such a configuration, due to the fact that a great part of the light-emitting units are disposed in the first light-emitting module 120 which have longer driving time, the average driving time of the light-emitting units in the light-emitting device 200 can be longer.

Furthermore, the light-emitting area of the first light-emitting module 120 can be increased by increasing the number of the light-emitting unit assemblies (such as D11-D14) connected in parallel (i.e., increasing the average-diode-junction-area A1) and by increasing the number of the light-emitting units connected in series in each of the light-emitting unit assemblies D11-D14 (i.e., increasing the average-number-of-diode-junctions S1).

As mentioned above, the average number of the diode-junction passed by the current paths are defined as average-number-of-diode-junctions S1 of the light-emitting module 120. For example, in this embodiment, if each of the light-emitting units in the light-emitting modules 120, 130, 140 includes one light-emitting diode, and the diode-junction-areas (e.g., P-N junction-areas) of these light-emitting diodes are the same, then the total number of the diode-junctions of the first light-emitting module 120 is equal to the total number of the light-emitting units in the first light-emitting module 120, that is, 12. In addition, there are 4 current paths passing through the first light-emitting module 120, (i.e., respectively passing through the light-emitting unit assemblies D11-D14). Thus, the average-number-of-diode-junction S1 of the first light-emitting module 120, which is the average number of the diode-junctions in each of the current paths, is 12/4=3. Similarly, the average-number-of-diode-junctions S2 of the second light-emitting module 130 is 3/3=1, and the average-number-of-diode-junctions S3 of the third light-emitting module 140 is 2/2=1.

Furthermore, as mentioned above, the value of the total diode-junction-area of the first light-emitting modules 120 divided by the average-number-of-diode-junction S1 of the light-emitting module 120 are defined as the average-diode-junction-area A1 of the first light-emitting modules 120. For example, in this embodiment, if each of the light-emitting units in the light-emitting modules 120, 130, 140 includes one light-emitting diode, and each of the diode-junction-areas of the light-emitting diodes is A, then the total diode-junction-area of the first light-emitting module 120 is 12 A. Due to the average-number-of-diode-junctions S1 of the first light-emitting module 120 is 3, the average-diode-junction-area A1 of the first light-emitting module 120, which is the value of the total diode-junction-area of the first light-emitting module 120 divided by the average-number-of-diode-junction S1 of the first light-emitting module 120, is 12 A/3=4 A. Similarly, the average-diode-junction-area A2 of the second light-emitting module 130 is 3 A/1=3 A, and the average-diode-junction-area A3 of the third light-emitting module 140 is 2 A/1=2 A.

In the abovementioned embodiment, the average-diode-junction-area A1 of the first light-emitting module 120 is different from the average-diode-junction-area A2 of the second light-emitting module 130 and the average-diode-junction-area A3 of the third light-emitting module 140. The average driving period of the light-emitting units in the light-emitting modules 120, 130, 140 can be increased by adjusting the average-diode-junction-areas and/or the average-number-of-diode-junctions of the light-emitting modules.

It is noted that, in another embodiment, each of the light-emitting units can be a package having a plurality of light-emitting diodes electrically connected in series. For example, each of the light-emitting units can have 6 light-emitting diodes electrically connected in series, and in such a case, S1=18, S2=6, S3=6. In addition, in still another embodiment, the light-emitting unit assembly D11 can have 4 light-emitting diodes electrically connected in series, the light-emitting unit assembly D12 can have 2 light-emitting diodes electrically connected in series, and both of the light-emitting assembles D13, D14 can have 3 light-emitting diodes electrically connected in series. In such a case, S1 still is 3, S2 still is 2, S3 still is 1 and the light-emitting unit assembly D12 can be driven before than the light-emitting assembles D13, D14 be. Furthermore, in some embodiment of the present invention, each of the light-emitting modules 120, 130, 140 can be constructed with complex light-emitting circuit assembly, in which the light-emitting diodes are electrically connected in series and parallel. For example, one of the light-emitting modules 120, 130, 140 can have 2 light-emitting unit assemblies connected in series, one of which contains 2 series of light-emitting diodes electrically connected in parallel to each other, and each series of light-emitting diodes contains 3 light-emitting diodes electrically connected in series. Another one of the 2 light-emitting assembles can contain 3 series of light-emitting diodes electrically connected in parallel to each other, and each series of light-emitting diodes contains 2 light-emitting diodes electrically connected in series. However, it should be noted that, the types of the light-emitting modules 120, 130, 140 is not limited to any example mentioned above.

Figure 4:
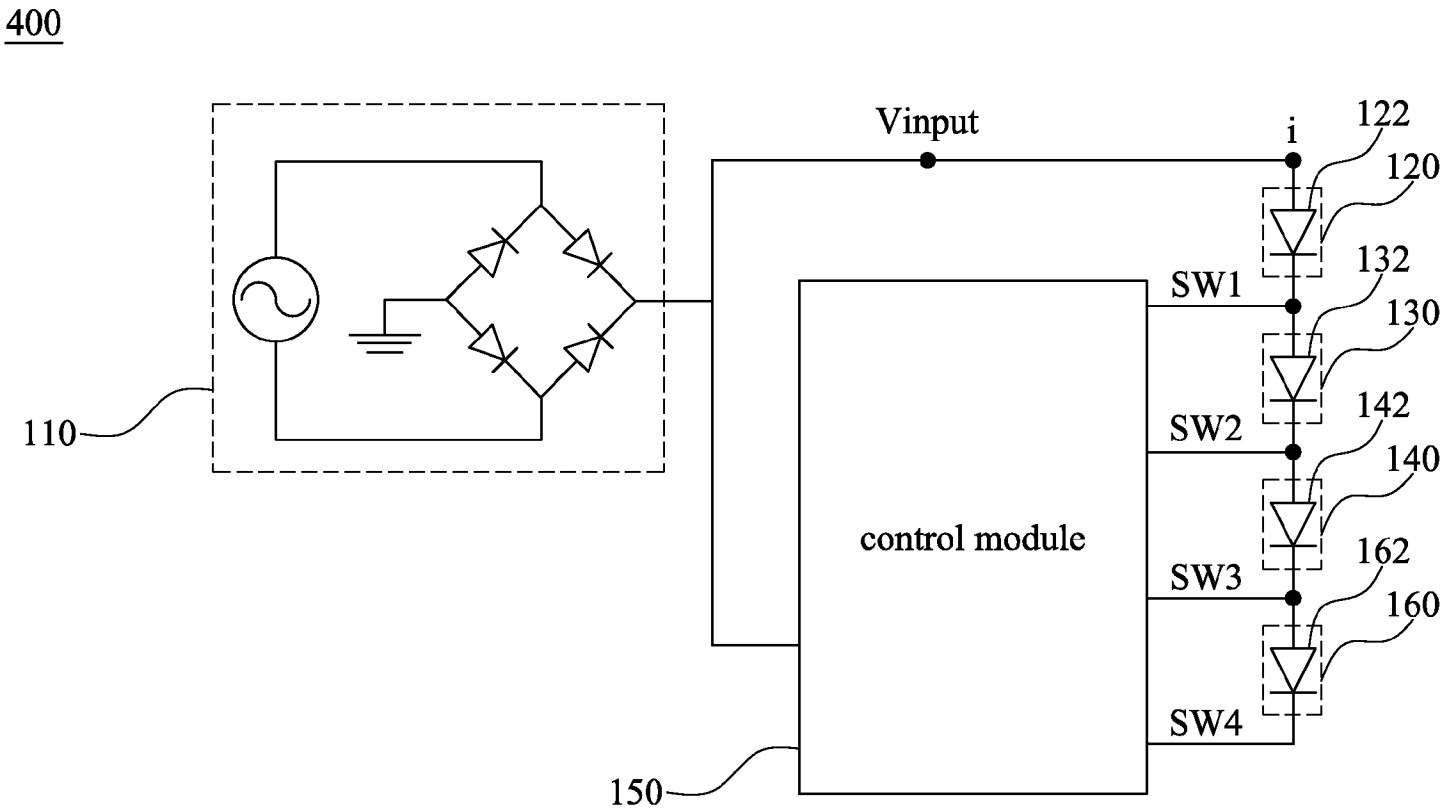
FIG. 4 is a light-emitting device in accordance with one embodiment of the present disclosure.

In addition, excepting from adjusting the average-diode-junction-areas A1, A2, A3 of the light-emitting modules 120, 130, 140 by adjusting number of the light-emitting unit assemblies (e.g., D11-D14) electrically connecting in parallel in the light-emitting modules 120, 130, 140, the average-diode-junction-areas A1, A2, A3 of the light-emitting modules 120, 130, 140 can also be adjusted by adjusting the diode-junction-areas of the light-emitting diodes of the light-emitting units in manufacturing process, so as to improve the luminous efficiency of the light-emitting device 200. FIG. 4 is a light-emitting device 400 in accordance with one embodiment of the present disclosure. In this embodiment, the light-emitting device 400 is substantially similar to the light-emitting device 200, except from that the light-emitting device 400 further includes a fourth light-emitting module 160, and the light-emitting device 400 has 7 driving stages.

In the first driving stage, the first light-emitting module 120 is driven by the driving voltage $V_{input}$, and a driving current flows in the first light-emitting module 120 from a node i and flows out from a path SW1. In the second driving stage, the first light-emitting module 120 and the second light-emitting module 130 are driven by driving voltage $V_{input}$, and another driving current flows in the first light-emitting module 120 and second light-emitting module 130 from the node i and flows out from a path SW2. In the third driving stage, the first light-emitting module 120, the second light-emitting module 130, and the third light-emitting module 140 are driven by driving voltage $V_{input}$, and still another driving current flows in the first light-emitting module 120, the second light-emitting module 130, and the third light-emitting module 140 from the node i and flows out from a path SW3. In the fourth driving stage, the first light-emitting module 120, the second light-emitting module 130, the third light-emitting module 140, and the fourth light-emitting module 160 are driven by driving voltage $V_{input}$, and still another driving current flows in the first light-emitting module 120, the second light-emitting module 130, the third light-emitting module 140, and the fourth light-emitting module 160 from the node i and flows out from a path SW4. The fifth driving stage, the sixth driving stage, and the seven driving stage are similar to the third driving stage, the second driving stage, and the first driving stage respectively, and thus, these driving stages would not be repeated herein.

In this embodiment, the first light-emitting module 120 includes a first light-emitting unit 122. The first light-emitting unit 122 is a packet containing light-emitting diodes electrically connected in series. Each of the diode-junction-areas of the light-emitting diodes in the first light-emitting unit 122 is 5 A. The second light-emitting module 130 includes a second light-emitting unit 132. The second light-emitting unit 132 is a packet containing 8 light-emitting diodes electrically connected in series. Each of the diode-junction-areas of the light-emitting diodes in the second light-emitting unit 132 is 4 A. The third light-emitting module 140 includes a third light-emitting unit 142. The third light-emitting unit 142 is a packet containing 7 light-emitting diodes electrically connected in series. Each of the diode-junction-areas of the light-emitting diodes in the third light-emitting unit 142 is 3 A. The fourth light-emitting module 160 includes a fourth light-emitting unit 162. The fourth light-emitting unit 162 is a packet containing 6 light-emitting diodes electrically connected in series. Each of the diode-junction-areas of the light-emitting diodes in the fourth light-emitting unit 162 is 2 A.

In this embodiment, based on the definitions above, the total number of diode-junction of the first light-emitting module 120 is 24, and the number of current path passing through the first light-emitting module 120 is 1, and therefore, the average-number-of-diode-junction S1 of the first light-emitting module 120 is 24. Similarly, the average-number-of-diode-junction S2 of the second light-emitting module 130 is 8, the average-number-of-diode-junction S3 of the third light-emitting module 140 is 7, and the average-number-of-diode-junction S4 of the fourth light-emitting module 160 is 6. In addition, the total diode-junction-area of the first light-emitting module 120 is 24×5 A=120 A, and the average-number-of-diode-junction S1 of the first light-emitting module 120 is 24 and therefore, the average junction area A1 of the first light-emitting module 120 is 120 A/24=5 A. Similarly, the average junction area A2 of the second light-emitting module 130 is 4 A, the average junction area A3 of the third light-emitting module 140 is 3 A, and the average junction area A4 of the fourth light-emitting module 160 is 2 A.

Therefore, by making the diode-junction-areas of the first light-emitting unit 122 of the first light-emitting module 120, the second light-emitting unit 132 of the second light-emitting module 130, the third light-emitting unit 142 of the fourth light-emitting module 140, and the fourth light-emitting unit 162 of the fourth light-emitting module 160 be different in manufacturing processes, the light-emitting area driven in the first driving stage can be increased, and the luminous efficiency of the light-emitting device 400 can be improved.

Figure 5:
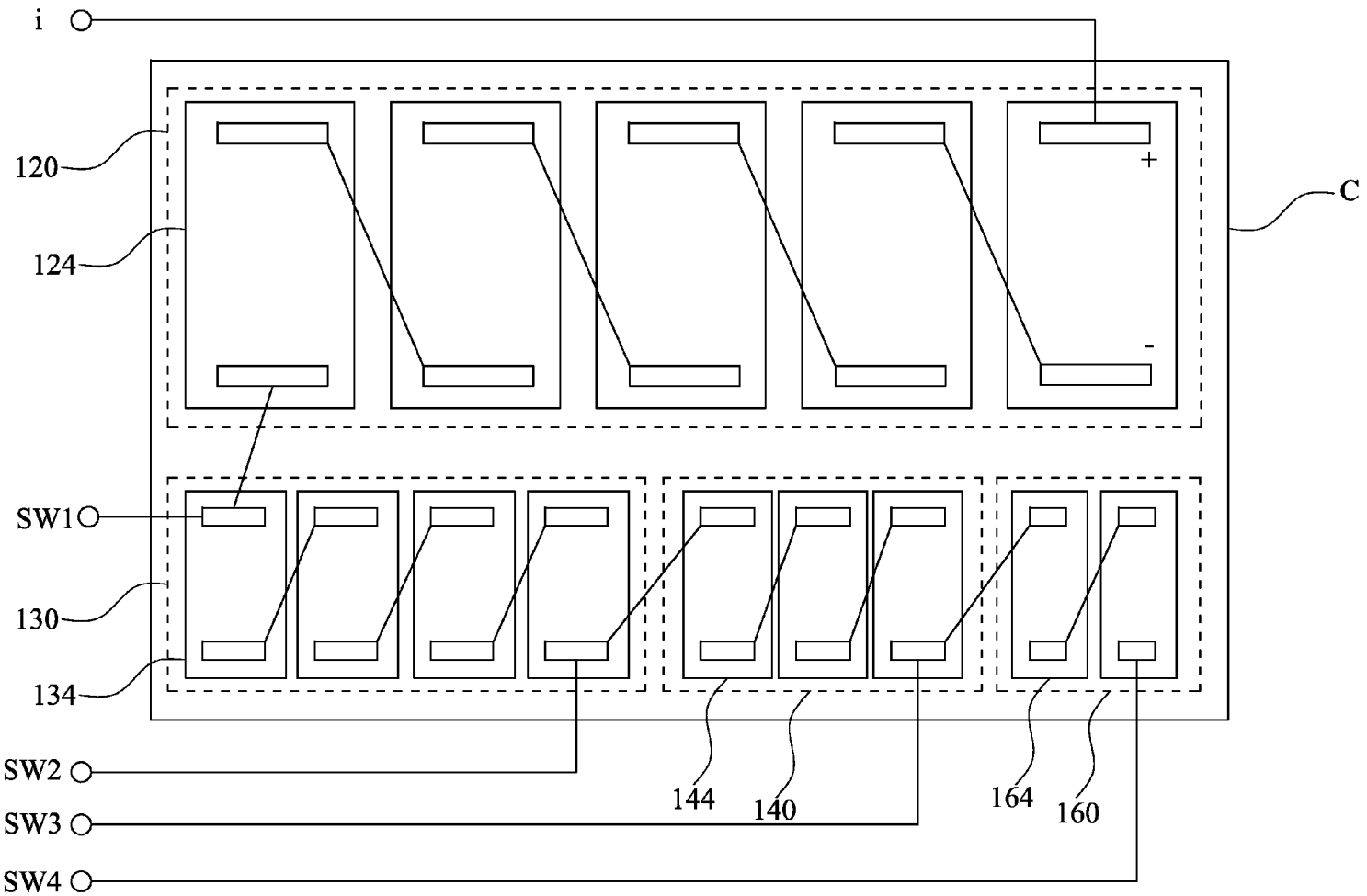
FIG. 5 illustrating one implementation of a first light-emitting module, a second light-emitting module, and a third light-emitting module in accordance with one embodiment of the present disclosure.

In one embodiment, the light-emitting modules of the light-emitting device can be implemented on a light-emitting diode chip, as shown in FIG. 5. In FIG. 5, light-emitting diode chip C can be divided to a plurality of regions, serving as the light-emitting modules 120, 130, 140, 160. The light-emitting modules 120, 130, 140, 160 are connected in series. The first light-emitting module 120 includes 6 first light-emitting regions 124, the second light-emitting module 130 includes 4 second light-emitting regions 134, the third light-emitting module 140 includes 3 third light-emitting regions 144, and the fourth light-emitting module 160 includes 2 fourth light-emitting regions 164. Each of the light-emitting regions 124, 134, 144, 164 can be regarded as a light-emitting diode, and the diode-junction-areas of the light-emitting regions 124, 134, 144, 164 can be different.

In addition, the light-emitting device in this embodiment also has 7 driving stages. The operating method of the light-emitting device in this embodiment is similar to which of the light-emitting device 400 in the previous embodiment, and therefore, it would not be repeated herein.

In the following paragraphs, some embodiment would be described. In these embodiments, some specific ratios about the average-number-of-diode-junctions and the average-diode-junction-areas of the light-emitting modules would be disclosed. By applying the disclosed ratios in the light-emitting devices, the light-emitting devices can have the better luminous efficiency.

In one embodiment, the light-emitting device 200 has 3 light-emitting modules (as showing in FIG. 2), which are a first light-emitting module 120, a second light-emitting module 130, and a third light-emitting module 140. In this embodiment, the average-number-of-diode-junction of the first light-emitting module 120, the average-number-of-diode-junction of the second light-emitting module 130, and the average-number-of-diode-junction of the third light-emitting module 140 are in a ratio of $\alpha:\beta:1$, where $\alpha$ and $\beta$ are $1\leq\alpha$ and $0.5\leq\beta$.

In addition, the average-diode-junction-area of the first light-emitting module 120, the average-diode-junction-area of the second light-emitting module 130, and the average-diode-junction-area of the third light-emitting module 140 are in a ratio of Q:R:1, where Q and R are $1.1\leq Q\leq 6$, and $0.5\leq R\leq 4$.

With the ratios of average-number-of-diode-junctions and the average-diode-junction-areas mentioned above, the light-emitting device 200 can have a better luminous efficiency.

In one embodiment, the light-emitting device 400 has 4 light-emitting modules (as showing in FIG. 4, 5), which are a first light-emitting module 120, a second light-emitting module 130, a third light-emitting module 140, and a fourth light-emitting module 160. In this embodiment, the average-number-of-diode-junction of the first light-emitting module 120 the average-number-of-diode-junction of the second light-emitting module 130, the average-number-of-diode-junction of the third light-emitting module 140, and the average-number-of-diode-junction of the fourth light-emitting module 160 are in a ratio of $\alpha:\beta:\gamma:1$, where $\alpha$, $\beta$, and $\gamma$ are $2\leq\alpha$, $0.5\leq\beta$, and $0.5\leq\gamma$.

In addition, the average-number-of-diode-junction of the first light-emitting module 120, the average-number-of-diode-junction of the second light-emitting module 130, the average-number-of-diode-junction of the third light-emitting module 140, and the average-diode-junction-area of the fourth light-emitting module 160 are in a ratio of Q:R:T:1, where Q, R, and T are $1.1\leq Q\leq 6$, $0.5\leq R\leq 4$, and $0.5\leq T\leq 4$.

With the ratios of average-number-of-diode-junctions and the average-diode-junction-areas mentioned above, the light-emitting device 400 can have a better luminous efficiency.

Figure 6:
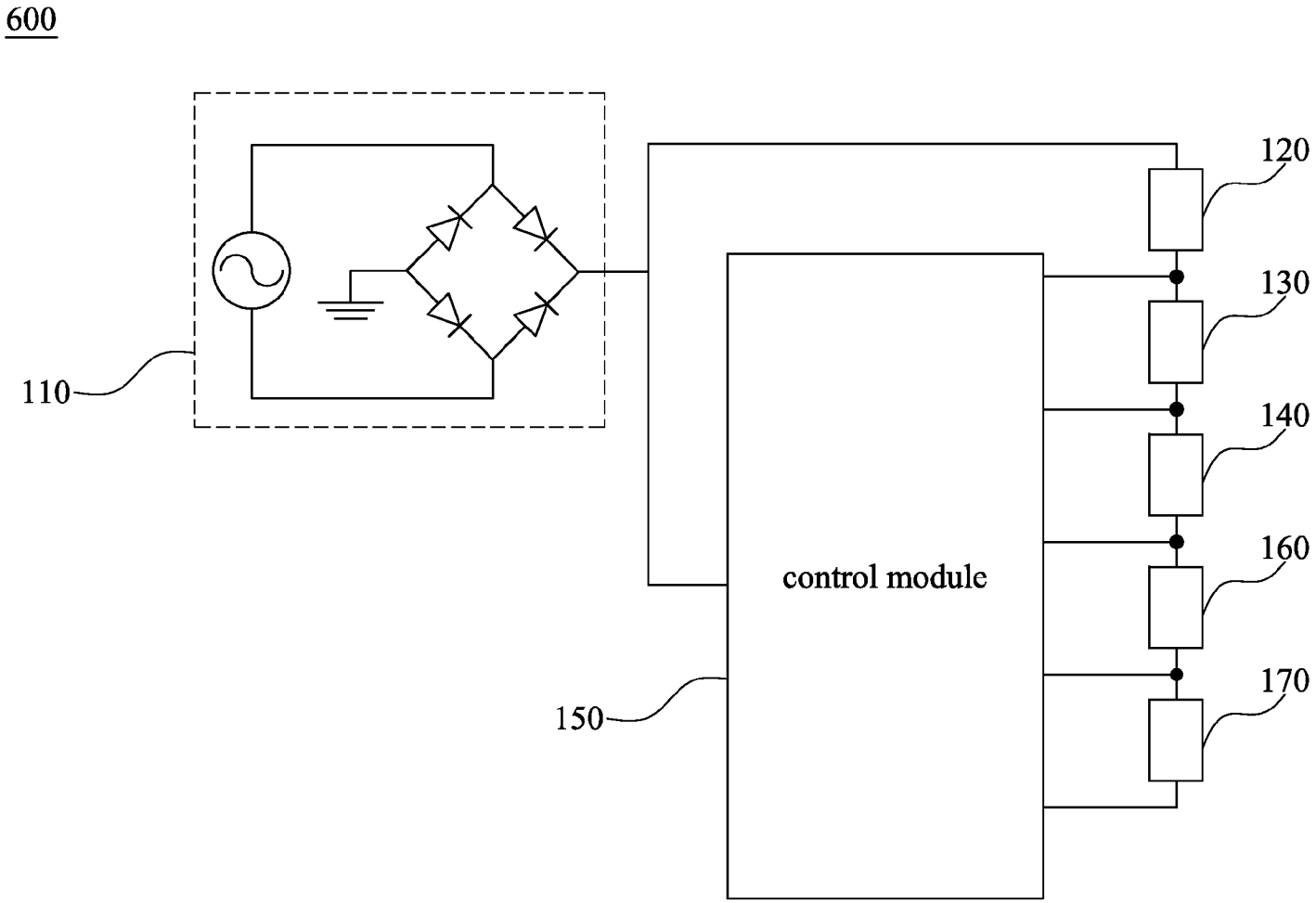
FIG. 6 is a light-emitting device in accordance with one embodiment of the present disclosure.

In one embodiment, the light-emitting device 600 has 5 light-emitting modules (as showing in FIG. 6), which are a first light-emitting module 120, a second light-emitting module 130, a third light-emitting module 140, a fourth light-emitting module 160, and a fifth light-emitting module 170. In this embodiment, the average-number-of-diode-junction of the first light-emitting module 120 the average-number-of-diode-junction of the second light-emitting module 130, the average-number-of-diode-junction of the third light-emitting module 140, the average-number-of-diode-junction of the fourth light-emitting module 160, and the average-number-of-diode-junction of the fifth light-emitting module 170 are in a ratio of $\alpha:\beta:\gamma:\delta:1$, where $\alpha$, $\beta$, $\gamma$, and $\delta$ are $2\leq\alpha$, $0.5\leq\beta$, $0.5\leq\gamma$, and $0.5\leq\delta$.

In addition, the average-number-of-diode-junction of the first light-emitting module 120, the average-number-of-diode-junction of the second light-emitting module 130, the average-number-of-diode-junction of the third light-emitting module 140, the average-diode-junction-area of the fourth light-emitting module 160, and the average-diode-junction-area of the fifth light-emitting module 170 are in a ratio of Q:R:T:U:1, where Q, R, T, and U are $1.1\leq Q\leq 6$, $0.5\leq R\leq 4$, $0.5\leq T\leq 4$, and $0.5\leq U\leq 3$.

With the ratios of average-number-of-diode-junctions and the average-diode-junction-areas mentioned above, the light-emitting device 600 can have a better luminous efficiency.

Figure 7:
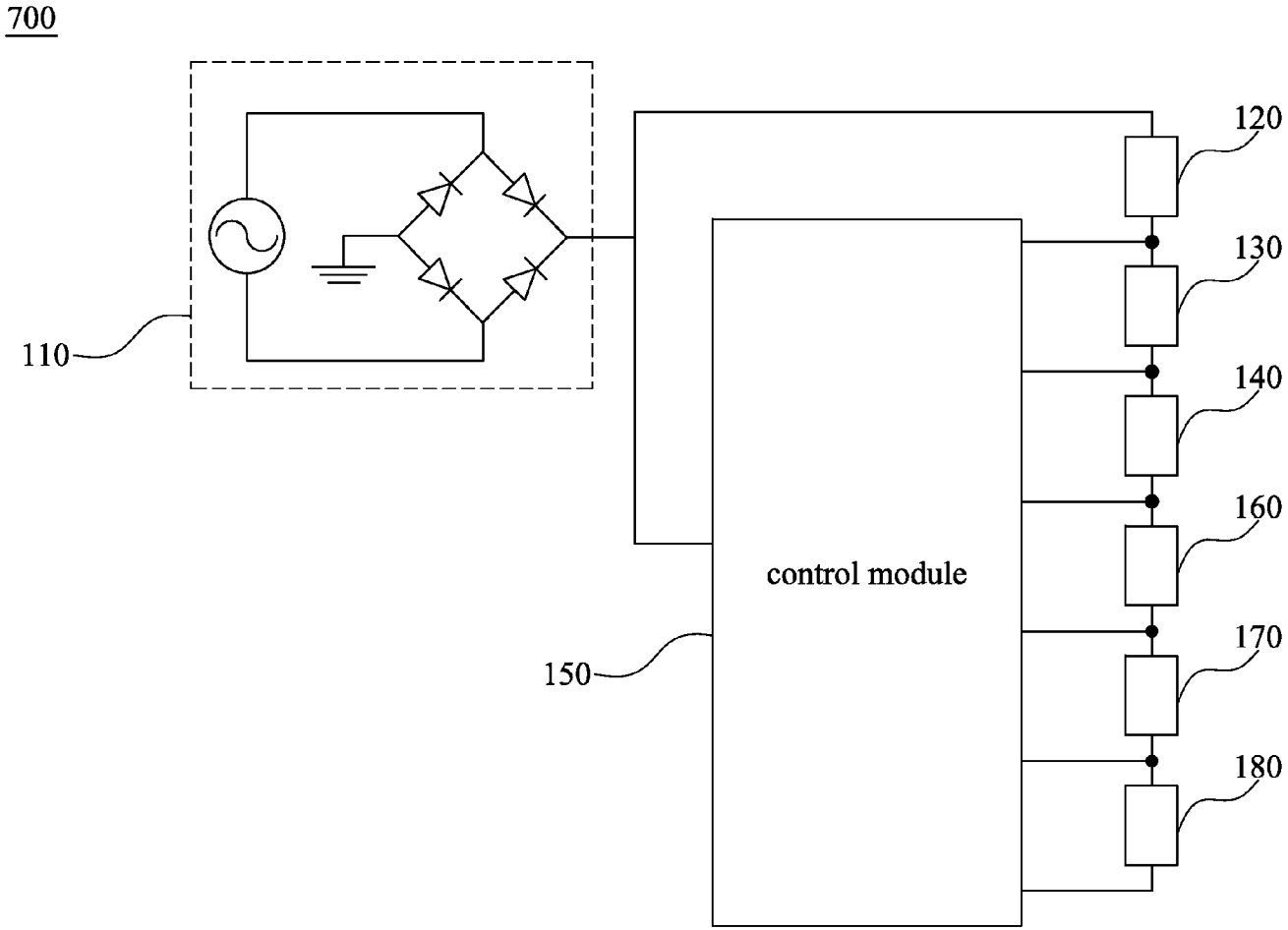
FIG. 7 is a light-emitting device in accordance with one embodiment of the present disclosure.

In one embodiment, the light-emitting device 700 has 6 light-emitting modules (as showing in FIG. 7), which are a first light-emitting module 120, a second light-emitting module 130, a third light-emitting module 140, a fourth light-emitting module 160, a fifth light-emitting module 170, and a sixth light-emitting module 180. In this embodiment, the average-number-of-diode-junction of the first light-emitting module 120 the average-number-of-diode-junction of the second light-emitting module 130, the average-number-of-diode-junction of the third light-emitting module 140, the average-number-of-diode-junction of the fourth light-emitting module 160, the average-number-of-diode-junction of the fifth light-emitting module 170, and the average-number-of-diode-junction of the sixth light-emitting module 180 are in a ratio of $\alpha:\beta:\gamma:\delta:\epsilon:1$, where $\alpha$, $\beta$, $\gamma$, $\delta$, and $\epsilon$ are $2\leq\alpha$, $0.5\leq\beta$, $0.5\leq\gamma$, $0.5\leq\beta$ and $0.5\leq\epsilon$.

In addition, the average-number-of-diode-junction of the first light-emitting module 120, the average-number-of-diode-junction of the second light-emitting module 130, the average-number-of-diode-junction of the third light-emitting module 140, the average-diode-junction-area of the fourth light-emitting module 160, the average-diode-junction-area of the fifth light-emitting module 170, and the average-diode-junction-area of the sixth light-emitting module 180 are in a ratio of Q:R:T:U:V:1, where Q, R, T, U, and V are $1.1 \leq Q \leq 6$, $0.5 \leq R \leq 4$, $0.5 \leq T \leq 4$, $0.5 \leq U \leq 4$, and $0.5 \leq V \leq 3$.

With the ratios of average-number-of-diode-junctions and the average-diode-junction-areas mentioned above, the light-emitting device 700 can have a better luminous efficiency.

Another aspect of the invention is a light-emitting device has 2N–(minus) 1 driving stages, and the light-emitting device includes N light-emitting modules. In a $P^{th}$ driving stage, if P is smaller than or equal to N, $1^{st}$ to $N^{th}$ light-emitting modules are driven and emit light, while if P is greater than N, light-emitting modules from the $1^{st}$ light-emitting module to the $(2N-(\text{minus})\ P)^{th}$ light-emitting module are driven and emit light.

For purpose of simplification and easy understanding, light-emitting devices is described as having fifth driving stages as example in the following paragraphs. However, one application of the present invention can be a light-emitting device having 3 stages, and the present invention is not limited to the light-emitting device described in the following embodiments.

Figure 8:
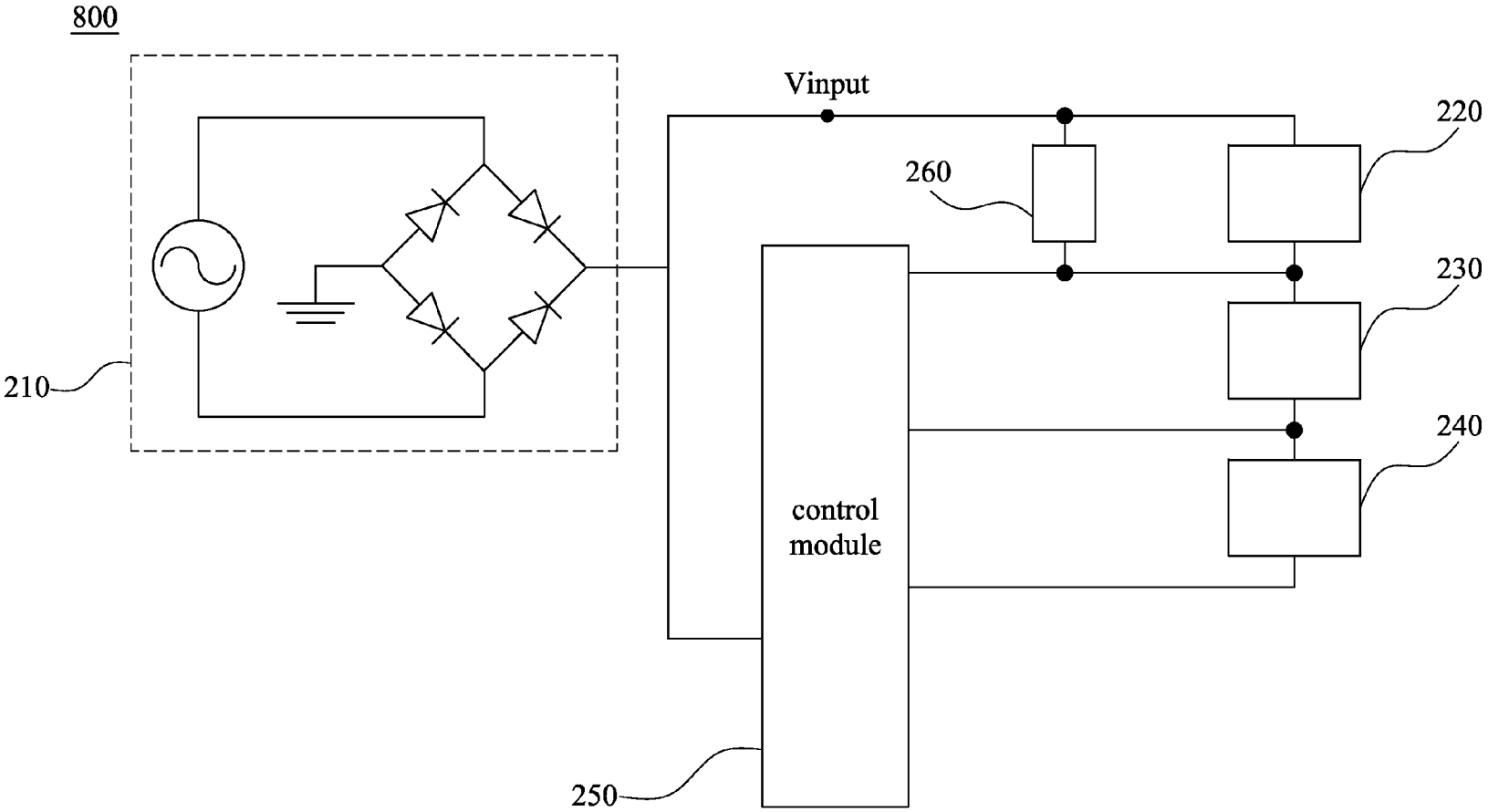
FIG. 8 is a light-emitting device in accordance with one embodiment of the present disclosure.

FIG. 8 is a light-emitting device 800 in accordance with one embodiment of the present disclosure. The light-emitting device 800 includes a power module 210, a first light-emitting module 220, a second light-emitting module 230, a third light-emitting module 240, and a control module 250. The light-emitting device 800 is substantially similar to the light-emitting device 200 in FIG. 2, and thus, the following paragraphs would just describe different parts between these two light-emitting devices.

Figure 9:
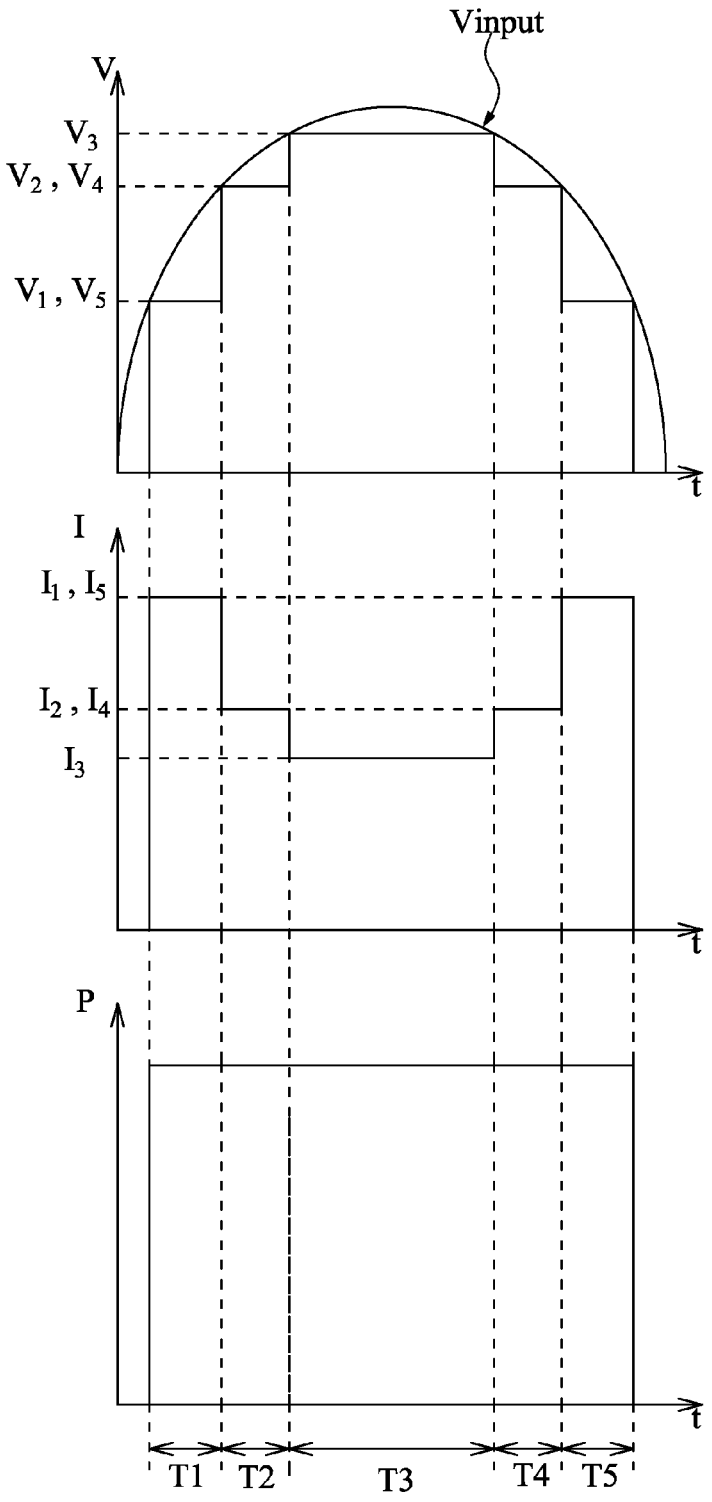
FIG. 9 is a diagram illustrating an operating waveform of the light-emitting device in FIG. 8.

Also referring to FIG. 9, in this embodiment, the light-emitting device 800 includes 3 light-emitting modules, and has 5 driving stages. In a first driving stage (i.e., period T1), the control module 250 makes the first light-emitting module 220 being driven by the driving voltage $V_{input}$, and provides a first driving current I1 to the first light-emitting module. A first cross voltage V1 is present across the first light-emitting module 220. In a second driving stage (i.e., period T2), the control module 250 makes the first light-emitting module 220 and the second light-emitting module 230 being driven by the driving voltage $V_{input}$, and provides a second driving current I2 to the first light-emitting module and the second light-emitting module 230. A second cross voltage V2 is present across the first light-emitting module 220 and the second light-emitting module 230. In a third driving stage (i.e., period T3), the control module 250 makes the first light-emitting module 220, the second light-emitting module 230, and the third light-emitting module 240 being driven by the driving voltage $V_{input}$, and provides a third driving current I3 to the first light-emitting module 220, the second light-emitting module 230, and the third light-emitting module 240. A third cross voltage V3 is present across the first light-emitting module 220, the second light-emitting module 230, and the third light-emitting module 240. In a fourth driving stage (i.e., period T4), the control module 250 makes the first light-emitting module 220 and the second light-emitting module 230 being driven by the driving voltage $V_{input}$, and provides a fourth driving current I4 to the first light-emitting module and the second light-emitting module 230. A fourth cross voltage V4 is present across the first light-emitting module 220 and the second light-emitting module 230. In a fifth driving stage (i.e., period T5), the control module 250 makes the first light-emitting module 220 being driven by the driving voltage $V_{input}$, and provides a fifth driving current I5 to the first light-emitting module. A fifth cross voltage V5 is present across the first light-emitting module 220.

In the operation above, the control module 250 can make the light-emitting modules 220, 230, 240 emit light evenly by manipulating the driving currents I1-I5 in the driving stages. More specifically, the control module 250 can make a difference between the product of the first driving current I1 and the first driving voltage V1 (that is, I1×V1), the product of the second driving current I2 and the second driving voltage V2 (that is, I2×V2), the product of the third driving current I3 and the third driving voltage V3 (that is, I3×V3), the product of the fourth driving current I4 and the fourth driving voltage V4 (that is, I4×V4), and the product of the fifth driving current I5 and the fifth driving voltage V5 (that is, I5×V5) be smaller than a predetermined threshold. In such a manner, luminous fluxes of the light-emitting modules 220, 230, 240 in the first to fifth driving stages are substantially the same (i.e., the differences of which are smaller than a predetermined ratio), and thus the flickering of the light-emitting device 800 can be reduced.

In addition, it should be understand that, an configuration of a light-emitting device including two light-emitting modules and 3 driving stages can be deduced by the embodiment described above, in which the first driving stage is the same as the first driving stage of the above embodiment, the second driving stage is the same as the second driving stage of the above embodiment, and the third driving stage is the same as the fifth driving stage of the above embodiment.

In addition, one skilled in the art can understand that the control module 250 can be implemented by a circuit assembly, which containing basic components such as comparators, adders, subtractors, controlling and protecting circuits, feedback circuits, amplifying circuits, current mirrors, switches, and so on. The switches are operative to separately be turned on in different driving stages, so as to make the light-emitting module 220, 230, 240 be driven by the driving voltage $V_{input}$ separately. The current mirrors are operative to provide the driving currents I1, I2, I3 to the light-emitting module 220, 230, 240. It should be noted that the embodiment described above is just an example, and the invention is not limited to the configuration in the above embodiment.

It should be noted that, based on the embodiment above, a light-emitting device having two light-emitting modules, which are the first light-emitting module 220 and the second light-emitting module 230 above mentioned, can be derived. Such a light-emitting device has 3 driving stages, in which the first and second stages of this light-emitting device are identical to the first and second stages of the light-emitting device 800 in the previous embodiment, and the third stage of this light-emitting device is identical to the fifth stage of the light-emitting device 800 in the previous embodiment.

In one embodiment, a difference Diff between a maximum and a minimum among the product of the first cross voltage V1 and the first driving current I1, the product of the second cross voltage V2 and the second driving current I2, the product of the third cross voltage V3 and the third driving current I3, the product of the fourth cross voltage V4 and the fourth driving current I4, and the product of the fifth cross voltage V5 and the fifth driving current I5 is a first value. A summation Sum of the maximum and the minimum among the product of the first cross voltage V1 and the first driving current I1, the product of the second cross voltage V2 and the second driving current I2, the product of the third cross voltage V3 and the third driving current I3, the product of the fourth cross voltage V4 and the fourth driving current I4, and the product of the fifth cross voltage V5 and the fifth driving current I5 is a second value. When a value of the difference Diff divided by the summation Sum is controlled to be smaller than 24%, that is, [MAX(I1×V1, I2×V2, I3×V3, I4×V4, I5×V5)−min(I1×V1, I2×V2, I3×V3, I4×V4, I5×V5)]/[MAX(I1×V1, I2×V2, I3×V3, I4×V4, I5×V5)+min(I1×V1, I2×V2, I3×V3, I4×V4, I5×V5)]<24%, then the flickering of the light-emitting device 800 can be not easily visually perceivable.

In one embodiment of the present invention, the light-emitting device 800 includes a power storage module 260. The power storage module 260 is electrically connected to the first light-emitting module 220. The power storage module 260 is charged or discharged corresponding to the driving voltage, and is configured to selectively drive the first light-emitting module 220. For example, the power storage module 260 can be a capacitor. When the first light-emitting module 220 is driven by the driving voltage $V_{input}$ provided by the power module 210, the power storage module 260 is charged, and when the driving voltage $V_{input}$ provided by the power module 210 is not sufficient to drive the first light-emitting module 220, the power storage module 260 is discharged, so as to replace the power module 210 to drive the first light-emitting module 220. In such a configuration, the power module 210 and the power storage module 260 can drive the first light-emitting module 220 alternatively, such that the first light-emitting module 220 can emit light constantly. As a result, the flickering of the light-emitting device 800 can be eliminated.

Moreover, in this embodiment, the charging speed of the power storage module 260 can be increased by making the first driving current I1 be greater than the fifth driving current I5, and/or by making the second driving current I2 be greater than the fourth driving current I4. In one embodiment, the first driving current I1 is greater than or equal to 0.9 times the fifth driving current I5, and/or the second driving current I2 is greater than or equal to 0.9 time the fourth driving current I4, such that the charging speed of the power storage module 260 can be increased. It should be noted that, although a capacitor electrically connected to the first light-emitting module 220 in parallel is taken as an example, but one skilled in the art should understand that the power storage module 260 can also be implemented by an inductor, and electrically connected to the first light-emitting module 220 in series, and the invention is not limited to the embodiment above.

Figure 10:
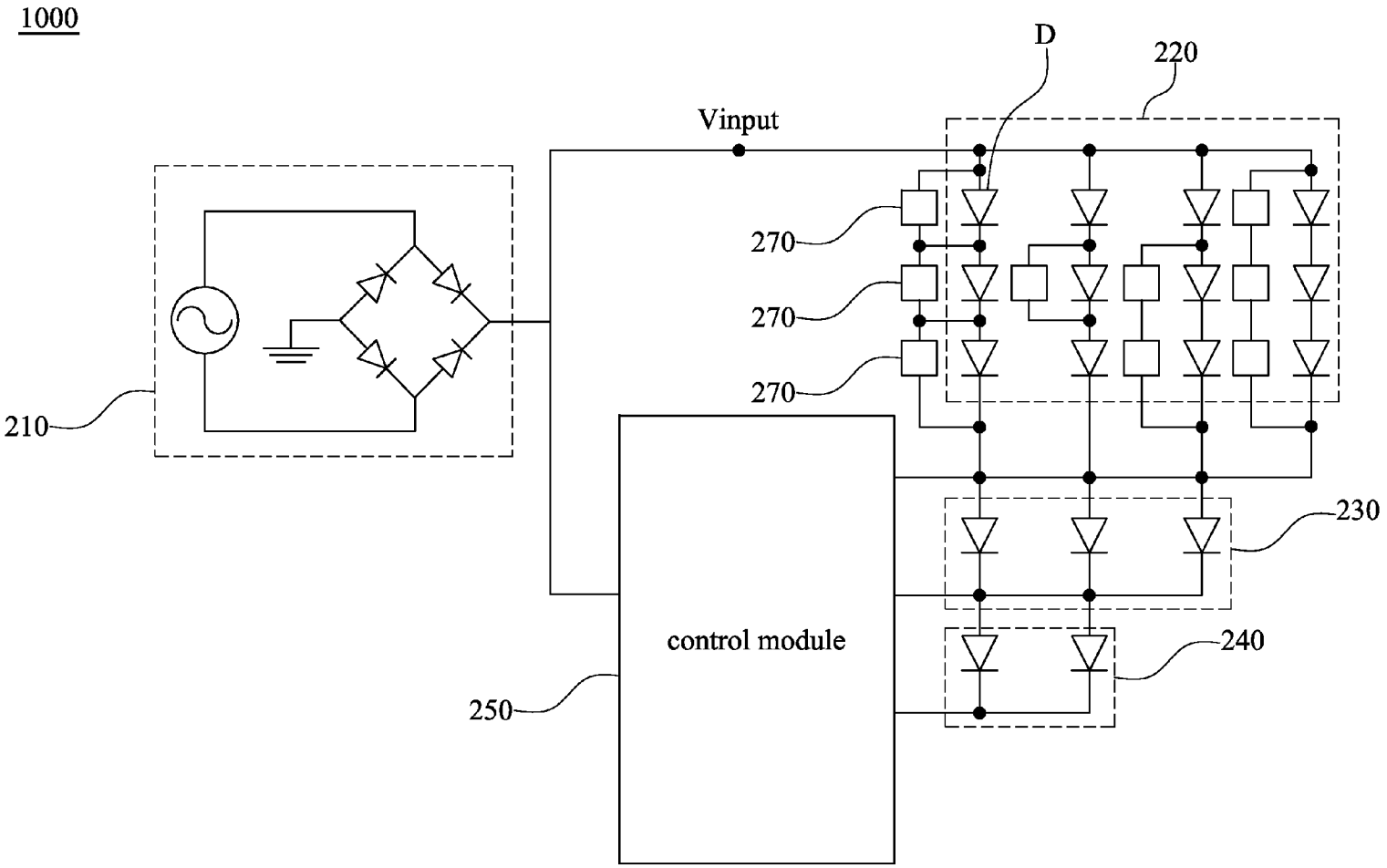
FIG. 10 is a light-emitting device in accordance with one embodiment of the present disclosure.

FIG. 10 is a light-emitting device 1000 in accordance with one embodiment of the present disclosure. The light-emitting device 1000 is substantially similar to the light-emitting device 800 in FIG. 8. Thus, the following paragraphs would just describe the different parts between the two light-emitting devices. In this embodiment, the light-emitting device 1000 includes a plurality of power storage modules 270. The first light-emitting module 220 includes a plurality of light-emitting units D. These light-emitting units D are connected to each other. The power storage modules 270 are selectively connected to the light-emitting units D in series or in parallel separately, and be charged or discharged correspond to the driving voltage $V_{input}$. Similar to the previous embodiment, the power storage modules 270 can be used to replace the power module 210 to drive the first light-emitting units D when the driving voltage $V_{input}$ provided by the power module 210 is not sufficient to drive the first light-emitting units D. In such a configuration, the voltage withstand capacity of the power storage modules 270 is smaller than the power storage module 260, and that is, in this embodiment, capacitors with capacitances smaller than the capacitance of the capacitor serving as the power storage module 260 in the light-emitting device 800 can be used to realize the power storage modules 270.

It should be noted that, although the power storage modules 260, 270 are electrically connected in parallel to the first light-emitting module 220 in the embodiment above, the power storage modules 260, 270 can also be electrically connected in parallel to the second light-emitting module 230 and/or the third light-emitting module 240, so as to reduce the flickering of the light-emitting device, and the invention is not limited to the embodiment above.

Figure 11:
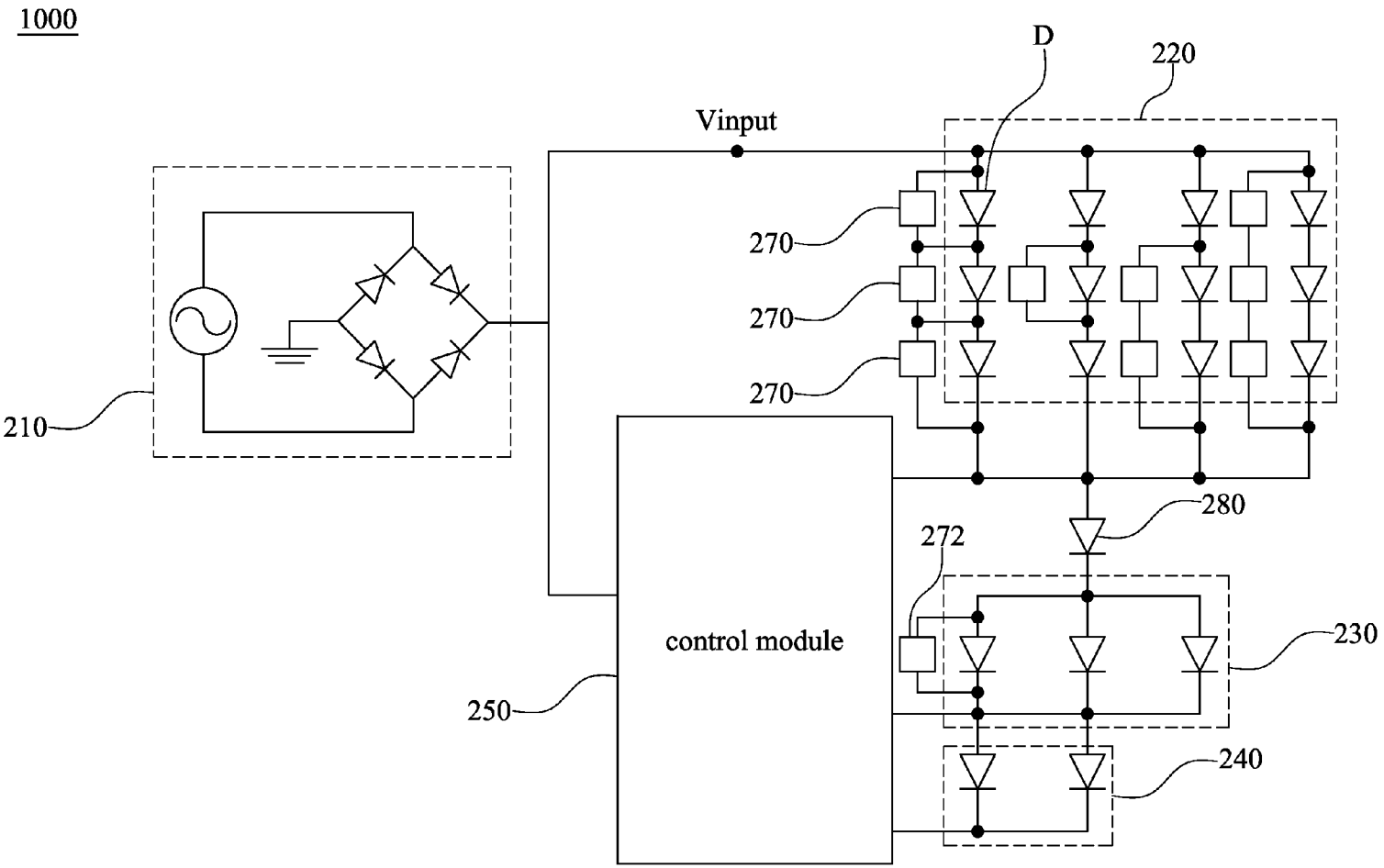
FIG. 11 is a light-emitting device in accordance with one embodiment of the present disclosure.

FIG. 11 is a light-emitting device 1100 in accordance with one embodiment of the present disclosure. The light-emitting device 1100 is substantially similar to the light-emitting device 1000 in FIG. 10. Thus, the following paragraphs would just describe the different parts between the two light-emitting devices. In this embodiment, the light-emitting device 1100 includes a power storage module 272 connected to the second light-emitting module 230. The power storage module 272 is configured to be charged and discharged corresponding to the driving voltage $V_{input}$, and to selectively drive the second light-emitting module 230. In addition, the light-emitting device 1100 includes an anti-backflow module 280. The anti-backflow module 280 is electrically connected between the first light-emitting module 220 and the second light-emitting module 230. One end of the anti-backflow module 280 is electrically connected to the first light-emitting module 220, and another end of the anti-backflow module 280 is electrically connected to second light-emitting module 230. The anti-backflow module 280 can be used to prevent that a backward current outputted from the power storage module 272 flows in the control module 250, so as to reduce the negative effect to the control module 250 caused by the power storage module 272. In one embodiment, the anti-backflow module 280 can be a diode (e.g., a light-emitting diode or a common diode). In addition, it is noted that, for preventing the backward current flows in the control module 250, the anti-backflow module 280 can be disposed between the first and the second light-emitting modules 220, 230, and/or the second and the third light-emitting modules 230, 240, and the disposition is not limited to the one in the above-mentioned embodiment.

Figure 12:
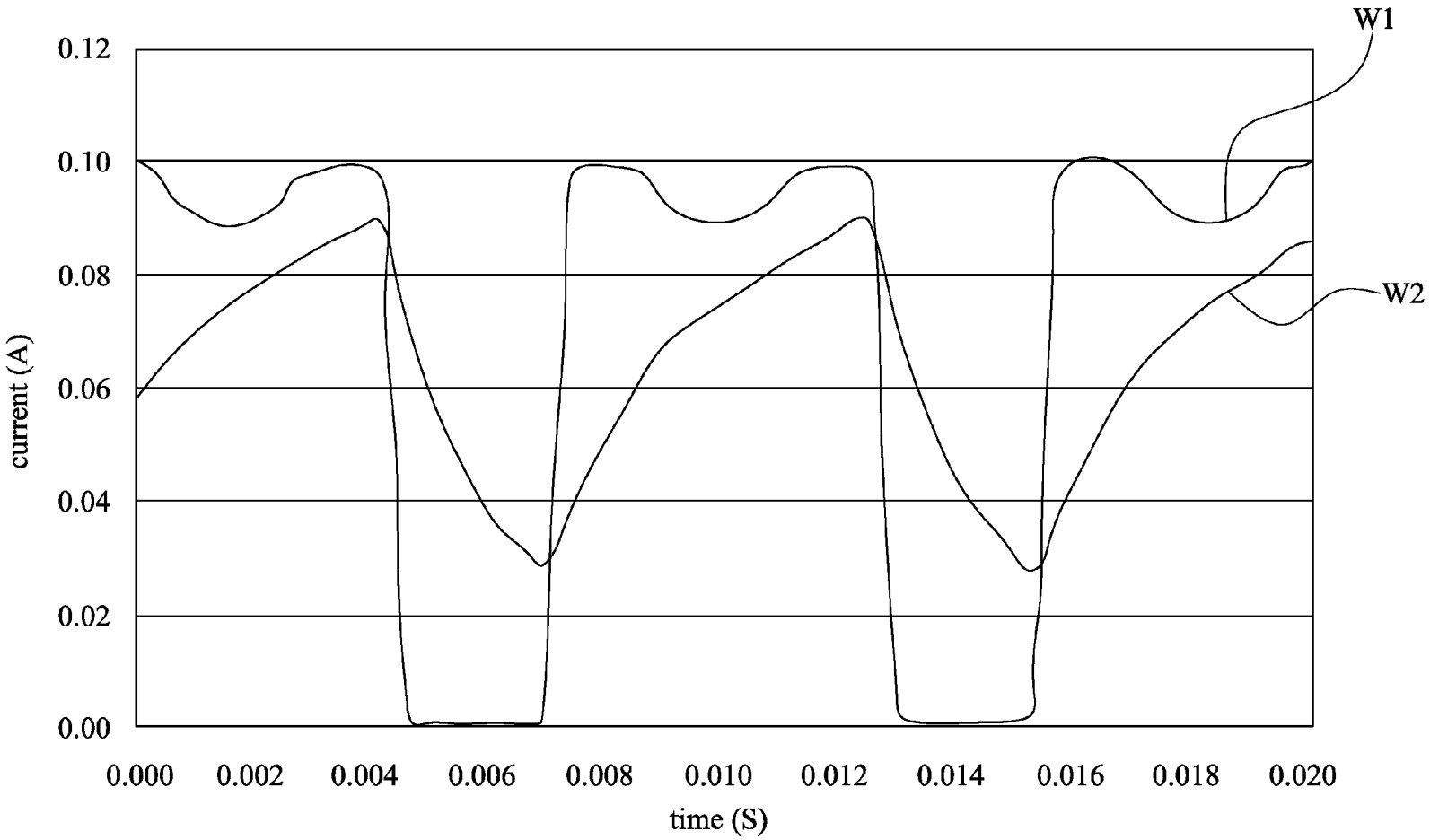
FIG. 12 is a diagram illustrating waveforms of driving currents in accordance with one embodiment of the present disclosure.

FIG. 12 is a diagram illustrating waveforms W1, W2 of driving currents in accordance with one embodiment of the present disclosure. The waveform W1 illustrating a driving current of a light-emitting device, in which the light-emitting modules inside are not electrically connected in parallel with a power storage component. The waveform W2 illustrating a driving current of a light-emitting device, in which the light-emitting modules inside are electrically connected in parallel with one or more power storage component. As illustrated in the waveform W1, when there is no power storage component connected to the light-emitting modules, every two ON periods are spaced by one OFF period, and the light-emitting device is accordingly flicker. On the other hand, as illustrated in the waveform W2, when there is one or more power storage component connected to the light-emitting modules, the driving current can accordingly be continuous, and the flickering problem of the light-emitting device can therefore be solved.

It should be noted that, although all of the light-emitting devices in the embodiment above have 5 driving stages and include 3 light-emitting modules, one skilled in the art should understand that, without departing from the scope or spirit of the invention, there can be an application of the invention in which a light-emitting device has 3 driving stages and include 2 light-emitting modules, or an application in which a light-emitting device has multiple driving stages and include multiple light-emitting modules It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A light-emitting device comprising:

a power module for rectifying an AC voltage to provide a driving voltage, wherein the driving voltage is periodic;

a first light-emitting module;

a second light-emitting module, wherein the first light-emitting module and the second light-emitting module are electrically connected to each other in series; and a control module for making the first light-emitting module and the second light-emitting module be driven by the driving voltage in response to different driving stages in one cycle period of the driving voltage, wherein, in a first driving stage of the driving stages in the one cycle period of the driving voltage, the control module makes the first light-emitting module being driven by the driving voltage, and provides a first driving current to the first light-emitting module, and a first cross voltage is present across the first light-emitting module;

in a second driving stage of the driving stages in the one cycle period of the driving voltage, the control module makes the first light-emitting module and the second light-emitting module being driven by the driving voltage, and provides a second driving current to the first light-emitting module and the second light-emitting module, and a second cross voltage is present across the first light-emitting module and the second light-emitting module, and the first driving current is different from the second driving current; and a product of the first cross voltage and the first driving current and a product of the second cross voltage and the second driving current are substantially identical, such that luminous fluxes of the first light-emitting module and the second light-emitting module in the first driving stage and the second driving stage are substantially identical.

2. The light-emitting device as claimed in claim 1, further comprising a third light-emitting module, electrically connected to the first light-emitting module and the second light-emitting module in series, wherein, in a third driving stage, the control module makes the first light-emitting module, the second light-emitting module, and the third light-emitting module being driven by the driving voltage, and provides a third driving current to the first light-emitting module, the second light-emitting module, and the third light-emitting module, and a third cross voltage is present across the first light-emitting module, the second light-emitting module, and the third light-emitting module;

in a fourth driving stage, the control module makes the first light-emitting module and the second light-emitting module being driven by the driving voltage, and provides a fourth driving current to the first light-emitting module and the second light-emitting module, and a fourth cross voltage is present across the first light-emitting module and the second light-emitting module;

in a fifth driving stage, the control module makes the first light-emitting module being driven by the driving voltage, and provides a fifth driving current to the first light-emitting module, and a fifth cross voltage is present across the first light-emitting module; and differences between a product of the first cross voltage and the first driving current, a product of the second cross voltage and the second driving current, a product of the third cross voltage and the third driving current, a product of the fourth cross voltage and the fourth driving current, and a product of the fifth cross voltage and the fifth driving current, are smaller than a predetermined threshold, such that differences of luminous fluxes of the first light-emitting module, the second light-emitting module, and the third light-emitting module between the first driving stage, the second driving stage, the third driving stage, the fourth driving stage, and the fifth driving stage are smaller than a predetermined ratio.

3. The light-emitting device as claimed in claim 2, wherein a difference between a maximum and a minimum among the product of the first cross voltage and the first driving current, the product of the second cross voltage and the second driving current, the product of the third cross voltage and the third driving current, the product of the fourth cross voltage and the fourth driving current, and the product of the fifth cross voltage and the fifth driving current is a first value;

a summation of the maximum and the minimum among the product of the first cross voltage and the first driving current, the product of the second cross voltage and the second driving current, the product of the third cross voltage and the third driving current, the product of the fourth cross voltage and the fourth driving current, and the product of the fifth cross voltage and the fifth driving current is a second value; and a value of the first value divided by the second value is smaller than 24%.

4. The light-emitting device as claimed in claim 2, wherein the first driving current is greater than or equal to the fifth driving current.

5. The light-emitting device as claimed in claim 2, wherein the second driving current is greater than or equal to the fourth driving current.

6. The light-emitting device as claimed in claim 1, further comprising a power storage module, electrically connected to the first light-emitting module, wherein the power storage module is charged or discharged corresponding to the driving voltage, and is configured to selectively drive the first light-emitting module.

7. The light-emitting device as claimed in claim 6, wherein the power storage module comprises a capacitor or an inductor.

8. The light-emitting device as claimed in claim 1, further comprising a plurality of power storage modules, wherein the first light-emitting module comprises a plurality of light-emitting units, the light-emitting units are electrically connected to each other, the power storage modules are selectively and electrically connected to the light-emitting units in series or in parallel, and are charged or discharged corresponding to the driving voltage, and are configured to selectively drive the light-emitting units.

9. The light-emitting device as claimed in claim 8, wherein the power storage module comprises a capacitor or an inductor.

10. The light-emitting device as claimed in claim 1, further comprising:

a power storage module electrically connected to the second light-emitting module in parallel, for being charged or discharged corresponding to the driving voltage, and for selectively driving the second light-emitting module; and an anti-backflow module, electrically connected between the first light-emitting module and the second light-emitting module in series.

* * * * *